US005238236A

United States Patent [19]

Belec et al.

[11] Patent Number: 5,238,236

[45] Date of Patent: Aug. 24, 1993

[54] DOCUMENT SINGULATING APPARATUS FOR FEEDING UPRIGHT DOCUMENTS OF VARYING THICKNESS

[75] Inventors: Eric A. Belec, Southbury; William J. Wright, Killingworth, both of Conn.

[73] Assignee: Pitney Bowes Inc., Stamford, Conn.

[21] Appl. No.: 974,755

[22] Filed: Nov. 12, 1992

[51] Int. Cl.[5] ..... B65H 3/04

[52] U.S. Cl. ..... 271/34; 271/122

[58] Field of Search ..... 271/34, 122, 124

[56] References Cited

U.S. PATENT DOCUMENTS

| | | | |
|---|---|---|---|
| 4,615,519 | 10/1986 | Holodnak et al. | 271/122 |
| 4,819,927 | 4/1989 | Noguchi et al. | 271/34 |
| 4,909,499 | 3/1990 | O'Brien et al. | 271/10 |
| 4,930,764 | 6/1990 | Holbrook et al. | 271/119 |
| 4,978,114 | 12/1990 | Holbrook | 271/35 |
| 5,074,540 | 12/1991 | Belec et al. | 271/34 |
| 5,092,574 | 3/1992 | Braen et al. | 271/2 |
| 5,129,642 | 7/1992 | Svyatsky et al. | 271/10 |

FOREIGN PATENT DOCUMENTS 2092558 9/1982 United Kingdom .

*Primary Examiner*—H. Grant Skaggs
*Assistant Examiner*—Carol Lynn Druzbick
*Attorney, Agent, or Firm*—Charles R. Malandra, Jr.; Melvin J. Scolnick

[57] ABSTRACT

Improvement to an apparatus for singulating respective documents fed thereto, the apparatus comprising first document feeding structure including first and second document feeding structure adjacent one another. The improvement is to the second document feeding structure and comprises a first section including an upstream end and a downstream end, the upstream end being pivotally mounted to a frame member, and including at least two outboard endless belts therearound and second structure for moving the outboard belts upstream relative to a path of travel in vertically spaced second belt runs; and a second section having at least two inboard endless belts therearound. The second section is pivotably mounted at one end to the first section. There is structure for coupling movement of the outboard belts of the first section to movement of the inboard belts of the second section for driving the inboard belts of the second section upstream relative to a path of travel in vertically spaced second section belt runs; and structure for resiliently urging the second section belt runs into interleaving relationship with the first belt runs, and for resiliently urging the downstream end of the first section belt runs towards the first belt runs. The urging structure enables the first and second sections to laterally flexed about the coupling structure in response to the documents fed thereto.

9 Claims, 4 Drawing Sheets

DOCUMENT SINGULATING APPARATUS FOR FEEDING UPRIGHT DOCUMENTS OF VARYING THICKNESS

BACKGROUND OF THE INVENTION

This invention is generally concerned with document singulating apparatus and more particularly with singulating apparatus including opposed, oppositely moving belts for singulating successive documents fed thereto.

In U.S. Pat. No. 4,930,764 entitled FRONT END FEEDER FOR A MAIL HANDLING MACHINE, issued Jun. 5, 1990 to Holbrook et al., belt structure has been provided for separating successive sheets from the bottom of a stack and feeding the sheets downstream to a sheet singulating structure which includes opposed belts moving in opposite directions. And, in U.S. Pat. No. 4,909,499 entitled MAIL SINGULATING APPARATUS, issued Mar. 20, 1990 to O'Brien et al., which includes a more detailed discussion of the singulating structure of the type shown in the Holbrook et al. patent, a mail piece singulating structure has been provided where oppositely moving upper and lower belts have been interleaved to form a nip for separating the successive lowermost mail pieces from mail pieces stacked thereon. And, in U.S. Pat. No. 4,615,519 entitled MAIL SEPARATING DEVICE, issued Oct. 7, 1986 to Holodnak et al., a belt structure has been provided for handling vertically oriented mail pieces to assure that only one mail piece at a time is fed into a mail processing machine. The belt structure is mounted on bell crank that is resiliently urged toward an adjustable stop member so that a predetermined minimum gap is maintained between the outer surface of the belt of the belt structure and the adjacent surface of a feeding roller regardless of the extent of wear on the belt.

Thus, it is generally known in the art to provide belt structures for separating successive documents from the bottom of the stack and forming a nip of interleaved belts for separating successive lower most documents from others stacked thereon. It is also generally known in the art to provide a document singulating apparatus for singulating documents fed thereto which are uprightly oriented on an edge thereof and have oppositely facing upright surface.

In U.S. Pat. No. 5,074,540 entitled DOCUMENT SINGULATING APPARATUS, issued Dec. 24, 1991 to Belec et al., belt structure has been provided for separating and singulating successive sheets vertically oriented. The belt structure includes opposed belts in an interleaved relationship moving in opposite directions with four adjustable springs used to control the forces applied to the documents being singulated. Although the Belec et al. structure has performed adequately, the trial and error adjustments to the tension of each spring effects the interrelationship of the forces of each belt. Since there are four springs involved with the adjustment, the adjustment may be difficult Accordingly, an object of the present invention is to provide an improved apparatus for singulating documents, including for example, mail pieces that are varying in surface finish and thickness;

Another object of the present invention is to provide an improved apparatus for singulating documents fed thereto, wherein the respective documents are uprightly oriented on an edge thereof and have oppositely facing upright surfaces These and other objects and advantages of the present invention will become apparent from an understanding of the following detailed description of the presently preferred embodiment of the present invention when considered in consideration with the accompanying drawings.

SUMMARY OF THE INVENTION

It has been found that the present invention provides an improvement to a singulation apparatus that successfully singulates documents of varying thickness and/ or surface finish with little or no need for any adjustments to compensate for material size or type.

The improvement in accordance with the present invention is an apparatus for singulating respective documents fed thereto, wherein each of the documents is uprightly oriented on an edge thereof and has oppositely facing upright surfaces, and wherein each successive document is slidably movable relative to a next successive document against an interdocument frictional force developed therebetween, and wherein the apparatus comprises first document feeding means including at least two first belts, and first means for moving the first belts downstream relative to a path of travel in vertically spaced first belt runs, and second document feeding means, adjacent the first document feeding means, including at least one second belt and second means for moving the second belt upstream relative to the path of travel in a second belt run. The improvement is to the second document feeding means and comprises a first section including an upstream end and a downstream end, the upstream end being pivotally mounted to a frame member, the first section also including at least two outboard endless belts therearound, the first section including second means for moving the outboard belts upstream relative to a path of travel in vertically spaced second belt runs. There is a second section having at least two inboard endless belts therearound, the second section being pivotably mounted at one end to the first section. The improvement further includes coupling means for coupling displacement of the outboard belts of the first section to the inboard endless belts of the second section for moving the inboard belts of the second section upstream relative to a path of travel in vertically spaced third belt runs. There are biasing means for resiliently biasing the third belt runs of the second section between the first belt runs of the first document feeding means such that the third belt runs are biased into interleaving relationship with the first belt runs, and for resiliently biasing the second belt runs of the first section into contact with the respective documents fed thereto. The biasing means enables the first and second sections to be laterally flexed about the coupling means in response to said documents fed thereto.

The first belt runs exert a downstream frictional force greater than an interdocument frictional force on an upright surface of each successive document for feeding thereof downstream in the path of travel. The first section and second section belt runs exert an upstream frictional force greater than the interdocument frictional force on the oppositely facing upright surface of each next successive document for feeding thereof upstream relative to the path of travel. The second section belt runs exert an upstream frictional force greater than the first section belt runs, and the downstream frictional force exceeds the upstream frictional force, whereby the first belt runs successively feed each successive document downstream in the path of travel against the interdocument and upstream frictional forces.

BRIEF DESCRIPTION OF THE DRAWINGS

As shown in the drawings wherein like reference numerals designate like or corresponding parts throughout several views.

DESCRIPTION OF THE PREFERRED EMBODIMENTS

Figure 1:
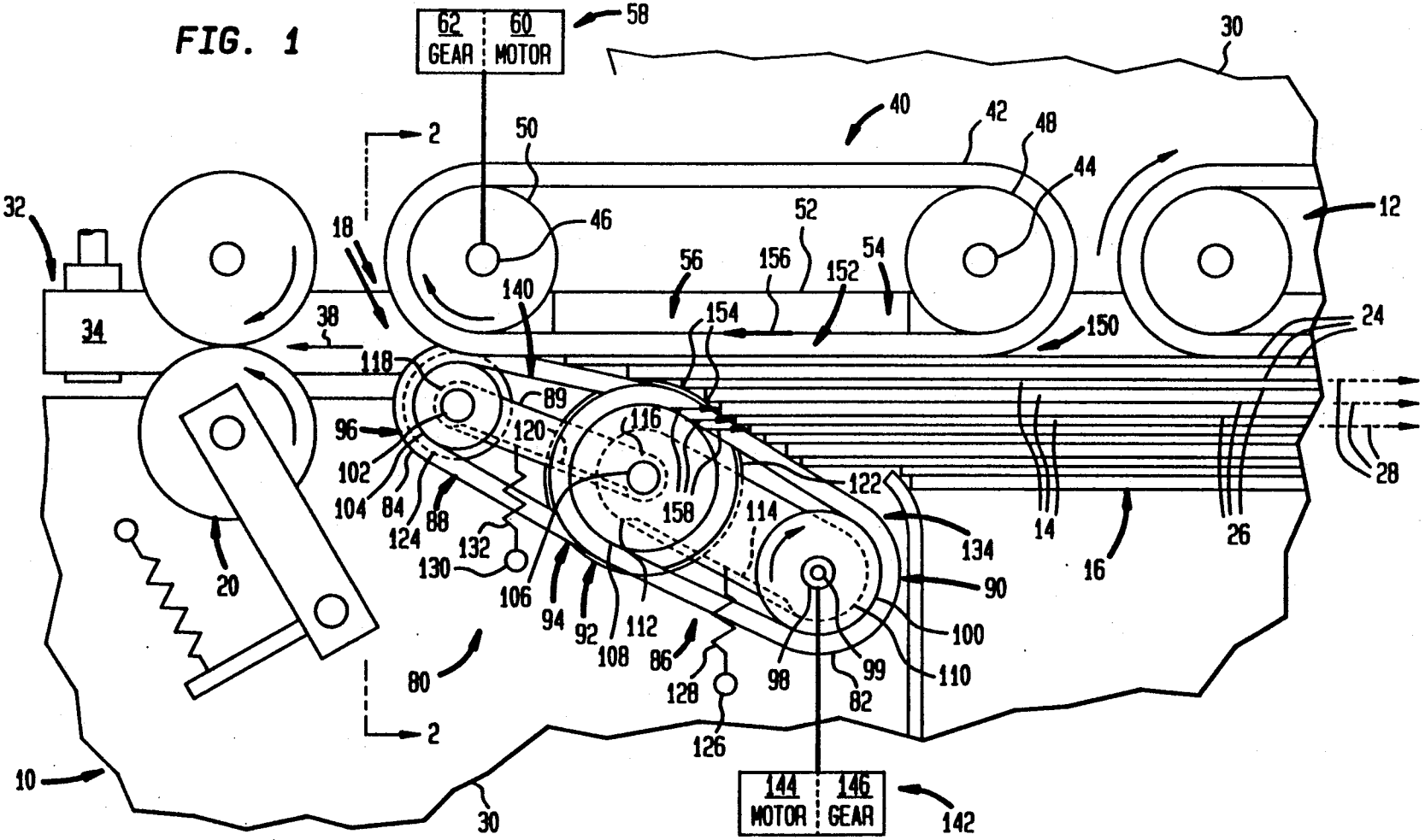
FIG. 1 is a partially schematic plan view of a system of an apparatus including belt structure according to the invention for singulating documents fed thereto.

Referring now to the Figures, a singulating apparatus, generally designated 10 (FIG. 1), according to the present invention comprises input feeding structure, generally designated 12, for feeding documents of varying thickness 14 from a stack, generally designated 16; document singulating apparatus, generally designated 18, for singulating documents 14 fed thereto; and output feeding structure, generally designated 20, for feeding documents 14 from the singulating structure 18.

Figure 3:
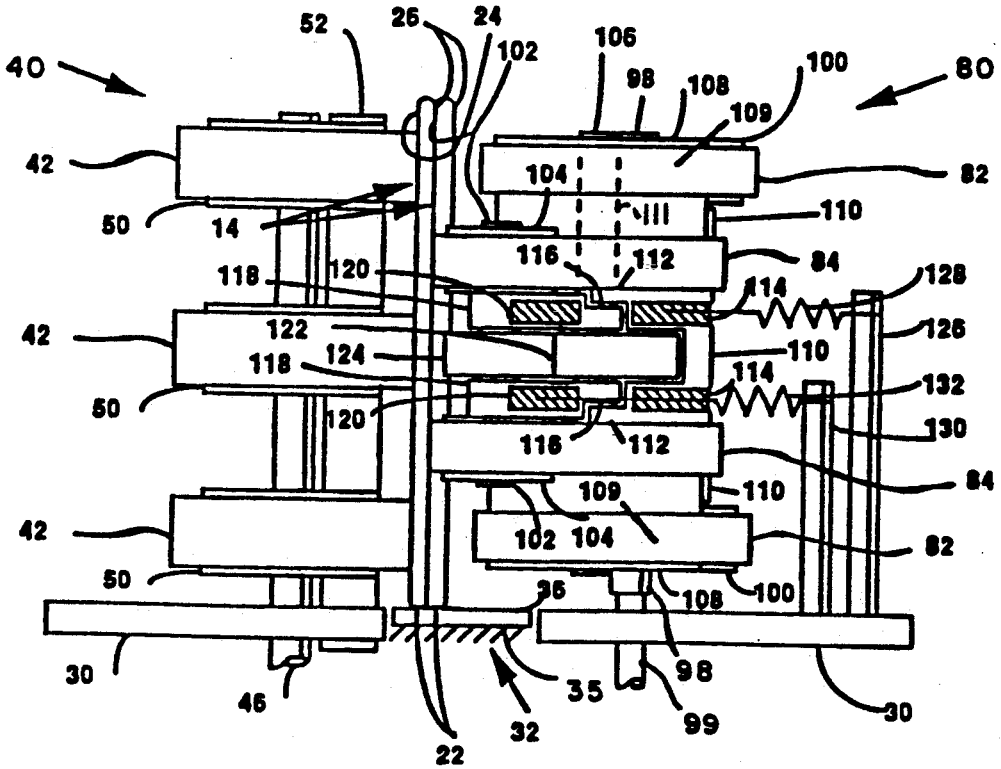
FIG. 3 is an end view, similar to FIG. 2, of the singulating apparatus of FIG. 1 but processing documents fed thereto.

For the purpose of this disclosure, a typical document of varying thickness 14 (FIG. 1) which may be singulated and fed by the system 10, may comprise an envelope, with or without one or more other documents stuffed therein which are or are not folded, or a sheet, such as a cut sheet, which is or is not folded, or a card, remittance form, mailpiece, or other sheet, or a collation of sheets which are or are not folded. Further, as shown in FIG. 3, for processing purposes, each of the documents 14 is preferably uprightly oriented on an edge 22 thereof and has oppositely outwardly facing, upright, surfaces 24 and 26. Moreover, it is assumed that each of the documents 14 fed to the singulating apparatus 18 is slidably movable, out of engagement with the next adjacent document 14, against an interdocument frictional force 28 developed between adjacent ones of surfaces., 24 and 26, in the course of such disengagement. In addition, although the documents 14 are shown as being fed from the stack 16 by means of belt-type input feeding structure 12, such structure 12 is intended to be representative of any document feeding structure which is constructed and arranged to be interfaced with the singulating apparatus 18 for feeding documents 14 fed therefrom.

Figure 2:
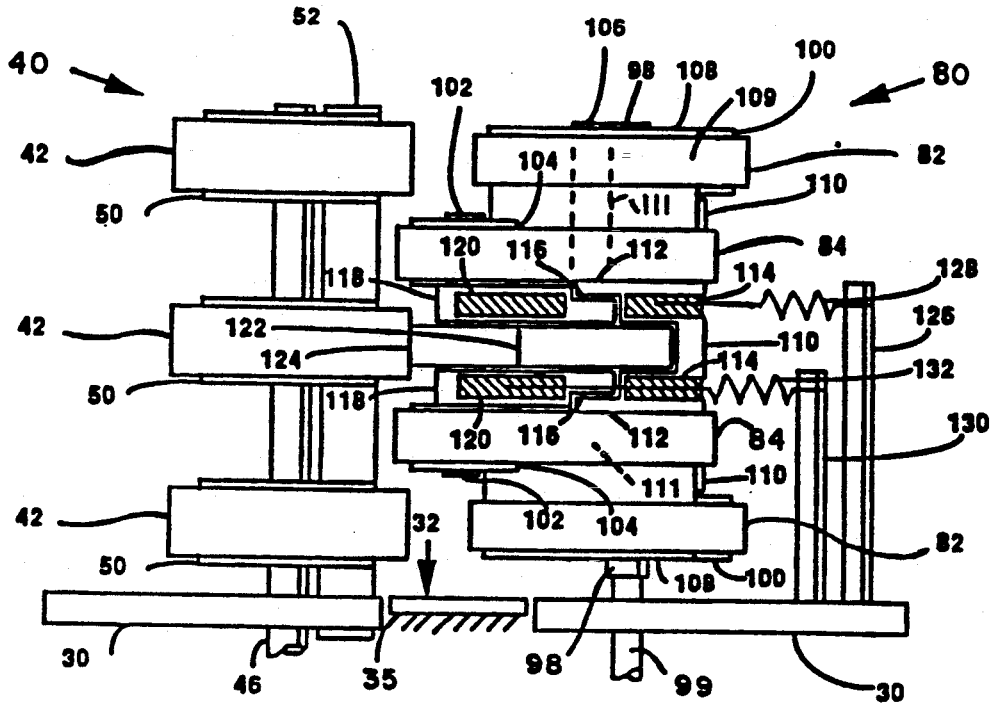
FIG. 2 is an end view of the singulating apparatus of FIG. 1 taken substantially along the line 2—2 of FIG. 1.

The document singulating apparatus 18 (FIG. 1) generally comprises a conventional framework 30 for supporting the various components of singulating apparatus 18, including a deck, generally designated 32, upon which the respective documents 14 are fed. Although the deck 32 is preferably a horizontally-extending conveyor belt 34 (as shown in FIG. 1), without departing from the spirit and scope of the invention, the deck 32 may be a conventional, horizontally-extending plate 35 (as shown in FIGS. 2 and 3), having an upper surface 36 which is coated with a suitable material having a low coefficient of friction, such as teflon or delrin, or the like, with a view to reducing frictional resistance to sliding movement thereon of the lower edges 22 (FIG. 3) of documents 14. In addition, the document singulating apparatus 1B (FIG. 1) generally includes a first document feeding structure, generally designated 40, for feeding each successive document 14 downstream along a path of travel 38 on the deck 32, and a second document feeding structure, generally designated 80, for feeding each next successive document 14 upstream relative to the path of travel 38.

The first document feeding structure 40 preferably includes three endless belts 42 (FIGS. 2 and 3). In addition, first document feeding structure 40 (FIG. 1) includes a pair of vertically oriented, parallel-spaced shafts 44 and 46, which are conventionally journaled to the framework 30 for rotation. Preferably, the upstream shaft 44 is an idler shaft and the downstream shaft 46 is a drive shaft. Further, first document feeding structure 40 includes three idler pulleys 48 corresponding to the number of belts 42, and a like number of downstream drive pulleys 50, which are respectively, conventionally mounted for rotation on the upstream and downstream shafts 44 and 46. Preferably, the pulleys 48 and 50 on each shaft 44 and 46 are located at substantially equally vertically-spaced intervals above the deck 32, and thus along the shafts 44 and 46 (FIG. 2). Each of belts 42 are looped about each pair of pulleys 48 and 50, which are located at the same interval on shafts 44 and 46, respectively, whereby the belts 42 extend substantially horizontally parallel to one another above the deck 32.

The first feeding structure 40 (FIG. 1) also includes a vertically oriented guide plate 52, which is conventionally fixedly connected to the framework 30 between the upstream and downstream shafts 44 and 46. As constructed and arranged, each belt 42 (FIG. 1) includes an upstream belt run, generally designated 54, which extends between an upstream idler pulleys 48 and the midpoint of a guide plate 52, and a downstream belt run, generally designated 56, which extends between the midpoint of guide plate 52 and downstream drive pulleys 50. Further, belts 42 (FIG. 2), and thus the respective upstream and downstream belt runs, 54 and 56, are suspended parallel to one another above deck 32 for feeding documents 14 downstream thereon. Moreover, guide plate 52 is parallel to the path of travel 38, and is dimensioned for aligning the downstream belt runs 56 relative to the output feeding structure 20, to support belts 42 and to optimally define the path of travel 38 for feeding documents 14 downstream therein to the output feeding structure 20. It will be understood that a plurality of support rollers could be used in place of guide plate 52 for the same purpose.

The first document feeding structure 40 (FIG. 1) additionally includes conventional drive structure 58, including a suitable motor 60, and a conventional gear system 62 interconnecting the motor 60 and downstream drive shaft 46, for driving the shaft 46 to move belts 42 downstream in their respective belt runs 54 and 56 for feeding documents 14 fed thereto downstream in the path of travel 38.

The second document feeding structure 80 (FIGS. 1, 2, 3 and 4) includes two outboard endless belts 82 and two inboard endless belts 84. In addition, the second document feeding structure 80 includes a first section, generally designated 86, and a second section, generally designated 88. First section 86 is connected to second section 88 in a manner that will be described below.

Figure 4:
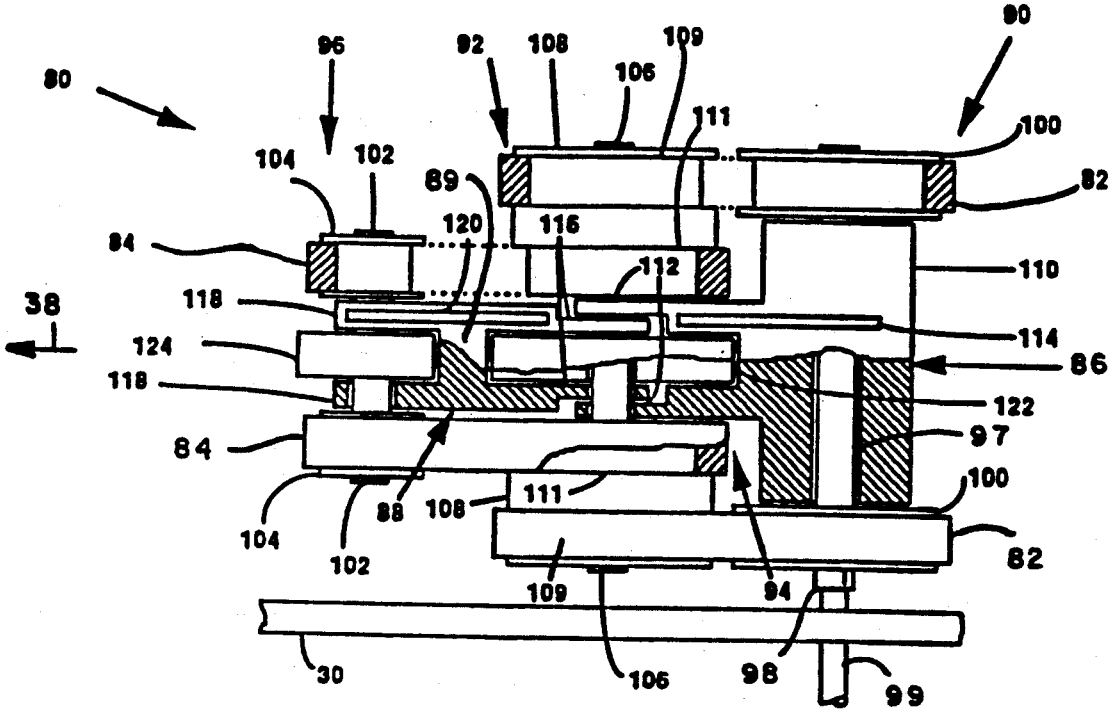
FIG. 4 is a partially fragmented side sectional view of the upstream feeding belt structure of the singulating apparatus of FIG. 1.

Referring now to FIGS. 1 and 4, first section 86 includes upstream and downstream ends, generally designated 90 and 92 respectively. Upstream end 90 includes an axle 98, which is coupled to a drive shaft 99. Axle 98 and drive shaft 99 are laterally and forwardly-spaced opposite idler shaft 44. Drive shaft 99 is conventionally journaled through the framework 30 for rotation in place. Further, first section 86 includes two upstream drive pulleys 100, corresponding to the number to the outboard belts 82, which are conventionally mounted for rotation at opposite ends of axle 98.

Second section 88 includes upstream and downstream ends, generally designated 94 and 96 respectively. Downstream end 96 includes an idler shaft 102 which is in vertical alignment with axle 98. Idler shaft 102 is shorter in length than axle 98 and is disposed entirely above deck 32 and is not connected to the framework 30. The means by which idler shaft 102 is rotationally displaced will be described below. Further, second section 88 includes two downstream idler pulleys 104, corresponding to the number of inboard belts 84. Pulleys 104 are conventionally mounted for rotation at vertically spaced intervals on idler shaft 102, which are between the vertically spaced intervals of pulleys 100 on axle 98.

Figure 5:
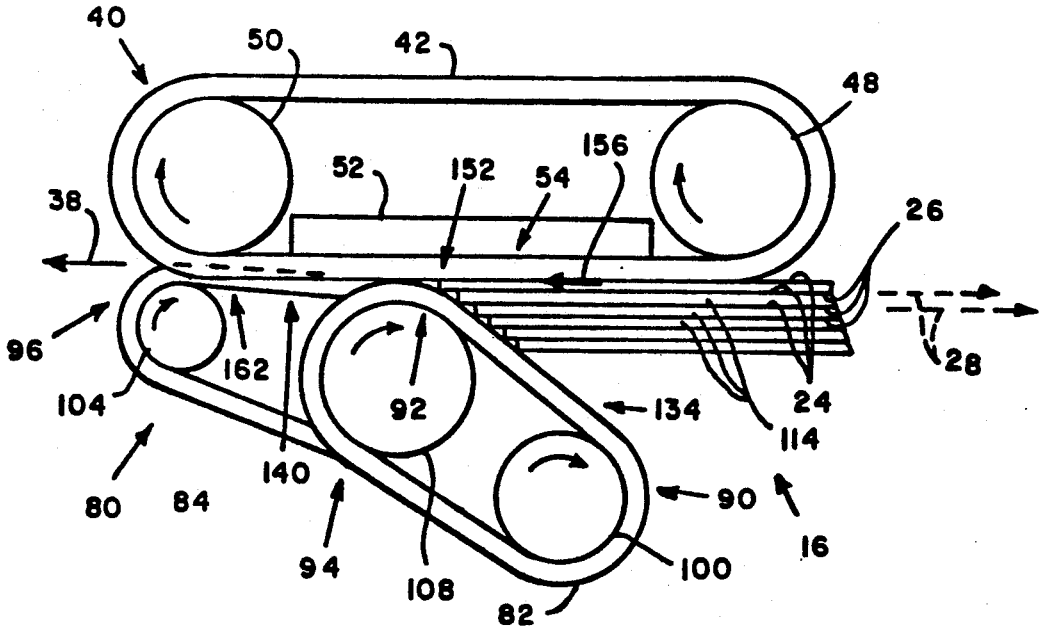
FIG. 5 is a plan view similar to FIG. 1, schematically showing a document initially being fed downstream by the belt structure of FIG. 1.
Figure 6:
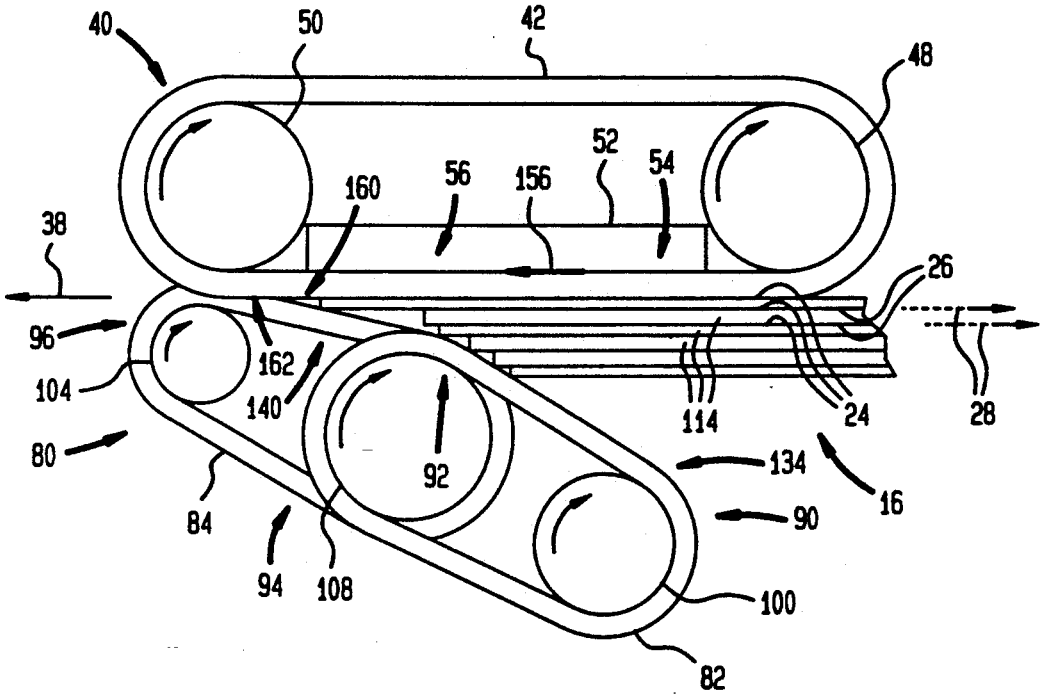
FIG. 6 is a plan view similar to FIG. 5, showing successive documents being fed downstream by the belt structure of FIG. 1.

Second section 88 is pivotably mounted at its upstream end 94 to the downstream end 92 of first section 86 by a coupling shaft 106. Coupling shaft 106 is an idler shaft that is located substantially midway between drive axle 98 and idler shaft 102, is substantially the same length as drive axle 98, but does not extend through framework 30. The means by which coupling shaft 106 is rotationally displaced will be described below. Further, coupling shaft 106 includes two double track pulleys 108, corresponding to the number of pairs of outboard belts 82 and inboard belts 84. Each pulley 108 has an outboard belt track 109 and an inboard belt track 111 (FIG. 4) to support a downstream end of one of the outboard belts 82 and an upstream end of one of the inboard belts 84, respectively. Pulleys los on coupling shaft 106 are located at vertically-spaced intervals along shaft 106, such that each outboard belt track 109 is in vertical alignment with a corresponding one of pulleys 100, and each inboard belt track 111 is in vertical alignment with a corresponding one of pulleys 104. In the preferred embodiment, the diameter of pulleys 104 are smaller than the diameter of pulleys 108 (FIGS. 1, 5 and 6).

Referring to FIGS. 1 and 4, first section includes a generally T-shaped first pivot arm 110 for pivotally connecting coupling shaft 106 to drive axle 98. In the preferred embodiment, first pivot arm 110 is slightly tapered (FIG. 1) horizontally moving from the upstream end 90 to the downstream end 92. The upstream end 90 of pivot arm 110 includes a substantially vertically oriented base portion having a vertically oriented aperture 97 through which axle 98 extends. Axle 98 is suitably journaled to pivot arm 110. The downstream end 92 includes a pair of elongate, parallel-spaced arm members 112 which extend horizontally from the downstream end 92 of first pivot arm 110. First pivot arm 110 is conventionally pivotally mounted to coupling shaft 106 through apertures in arm members 112 which are positioned between coupling pulleys 108 such that coupling shaft 106 and coupling pulleys 108 can pivot around axle 98 and drive shaft 99. The second section 88 includes a generally H-shaped second pivot arm 89 for pivotally connecting idler shaft 102 to coupling shaft 106. In the preferred embodiment, second pivot arm 89 is slightly tapered (FIG. 1) horizontally moving from the upstream end 94 to the downstream end 96. Second pivot arm 89 includes two pairs of elongate, parallel-spaced arm members 118 and 116 which respectively extend horizontally from the downstream end 96 and the upstream end 94 of second pivot arm 89. Second pivot arm 89 is conventionally mounted to idler shaft 102 through apertures in arm members 118 which are positioned between idler pulleys 104. Second pivot arm 89 is conventionally pivotally mounted to coupling shaft 106 through apertures in arm members 116 which are positioned between arm members 112 of first pivot arm 110, whereby first section 86 and second section 88 can pivot in opposite directions about axle 98 and shaft 106, respectively, as documents 14 are fed through singulating apparatus 18. Thus, second document feeding section 80 conforms to the documents being singulated therefrom.

Inboard belts 84 are endlessly looped about the pulleys 104 and inboard belt tracks 111 of pulleys 108, whereby the belts 84 extend substantially horizontally parallel to one another, in vertically-spaced intervals above the deck 32. Belts 84 are centered between the horizontally extending intervals in which the belts 42 are located, to permit each of the belts 84 to be interleaved with two of the belts 42.

As shown in FIGS. 1, 2 and 3, second document feeding structure 80 includes an adjustable first spring 128, such as a torsion spring, having one end conventionally connected to the framework 30, as by means of a vertically oriented post 126, and the other end suitably bearing in a first biasing groove 114 of the first section 86 for resiliently and laterally urging the first section 86 and thus, the outboard belts 82, toward the first document feeding structure 40. Since axle 98 operates as a stationary axis for first and second sections 86 and 88, the downstream end 92 of first section 86 is urged toward first feeding structure 40. Further, second document feeding structure 80 includes a second adjustable spring 132, such as a torsion spring, having one end conventionally connected to the framework 30, as by means of a vertically oriented post 130, and the other end suitably bearing in a second biasing groove 120 of the second section 88 for resiliently and laterally urging the second section 88 and thus, inboard belts 84, toward first document feeding structure 40, causing an interleaving relationship with belts 42 of the first document feeding structure 40. Since second section 88 is pivotably mounted at its upstream end 94 to coupling shaft 106 and first section 86 is rotatably mounted at its downstream end 92 to coupling shaft 106, the second document feeding means 80 laterally flexes about coupling shaft 106, deforming springs 128 and 132 when documents 14 pass therethrough.

The second feeding structure 80 also includes a pair of stop rollers 122 and 124 which are rotatably mounted on coupling shaft 106 and idler shaft 102 respectively for disposition in rolling engagement with the downstream end of the middle one of belts 42. Stop rollers 122 and 124 are dimensioned for laterally aligning the belts 84 with the belts 42 at the downstream end of the downstream belt run 56, whereby the belts 84 thereat are disposed interleaved relationship with the belts 42. In the preferred embodiment of the present invention, the diameter of stop rollers 122 and 124 are slightly smaller than the diameter of pulleys 108 and 104 respectively with belts 84 mounted thereon, whereby when stop rollers 122 and 124 engage the middle one of belts 42, belts 84 are in a laterally interleaved relationship with belts 42.

As thus constructed and arranged, each belt 82 includes an belt run, generally designated 134, which extends between a guide pulleys 108 and an upstream drive pulleys 100, and each belt 84 includes a belt run 140, which extends between downstream idler pulleys 104 and guide pulleys 108. Further, the belts 82 and 84 (FIG. 3), and thus belt runs 134 and 140 thereof extend parallel to one another, and both belt runs 134 and 140 overhang the deck 32 for feeding documents 14 upstream thereon.

Further, the second feeding structure 80 (FIG. 1) includes conventional drive structure 142, including a suitable motor 144, and a conventional gear system 146 interconnecting the motor 144 and upstream drive shaft 99, for driving shaft 99 and axle 98 to move the outboard belts 82 and inboard belts 84 upstream in their respective belt runs, 134 and 140, for feeding documents 14 fed thereto upstream relative to the downstream path of travel 38. It will be understood by those skilled in the art that the counterclockwise rotation of inboard belts 82 and 84 (FIGS. 1, 5 and 6) cooperates with springs 128 and 130 to bias second section 88 and the downstream end of first section 86 toward first feeding structure 40.

Referring now to FIGS. 5 and 6, when documents 14 are not being fed to singulating apparatus 18 the belt runs 140 of belts 84 in second feeding structure 80 are parallel to the belt runs 56 of belts 42 in first feeding structure 40, whereby stop rollers 122 and 124 are biased against the middle one of belts 42 (FIG. 2). On the other hand, the belt runs 134 of the second document feeding structure 80 extends progressively upstream and is laterally spaced from the upstream end of, and cooperates with, the upstream belt runs 54 of the first feeding structure 40 to define a wedge-shaped document entry opening, generally designated 150 into which documents 14 are fed into overlapping relationship with one another from the input feeding structure 12. As the documents 14 enter the opening 150, the upstream belt runs 54 of the first feeding structure 40 frictionally engage the upright surface 24 of the document 14 fed into engagement therewith, and feed the same downstream relative to the path of travel 38 to a nip 152, formed by the belts 42 and 82, at the juncture of the wedge-shaped opening 150. In addition, the belt run 134 of the second feeding structure 80, frictionally engages the downstream leading edges 154 of each of the documents 14 within the wedge-shaped opening 150, and tends to feed the documents 14 upstream relative to the path of travel 38. Due to downstream force 156 exerted against the document surface 24, by the belt runs 54, exceeding the interdocument frictional force 28, and exceeding the upstream force 158 exerted by the belt run 134, the document 14 engaged by the upstream belt run 54 is normally fed downstream into the nip 152. Whereupon the belt 84, and thus pulleys 108 (FIG. 4), are laterally moved away from the path of travel 38 by the document 14, against the resilient urging of the spring 128, thereby opening the nip 152, as document 14 is fed downstream in the path of travel 38 between the downstream belt runs 56 and belt runs 140. Moreover, the document 14 is then fed downstream by the downstream belt runs 56 against an upstream frictional force 158 (FIGS. 1 and 6) exerted by the belt run 140. As shown in FIGS. 4 and 5, the downstream belt runs 56 and belt runs 140, define a second wedge-shaped opening, generally designated 160, having a downstream nip, generally designated 162, which progressively moves downstream until the document 14 is fed downstream to the pulleys 50 and 104 due to the document 14 engaged by the downstream belt runs 56 progressively urging belt runs 140 out of interleaving relationship with the belt runs 56. And, when the document 14 is fed to the nip 162 formed by the interleaved belts 42 and 84 at the downstream end of the belt runs 56 and 140 the document 14 then urges the belt 84 out of interleaving relationship with the belts 42, against the resilient urging of the spring 132, whereby the nip 162 is opened. Whereupon the document 14 is fed downstream between the rollers 50 and 104 t o the output feeding structure 20 (FIG. 1).

Figure 7:
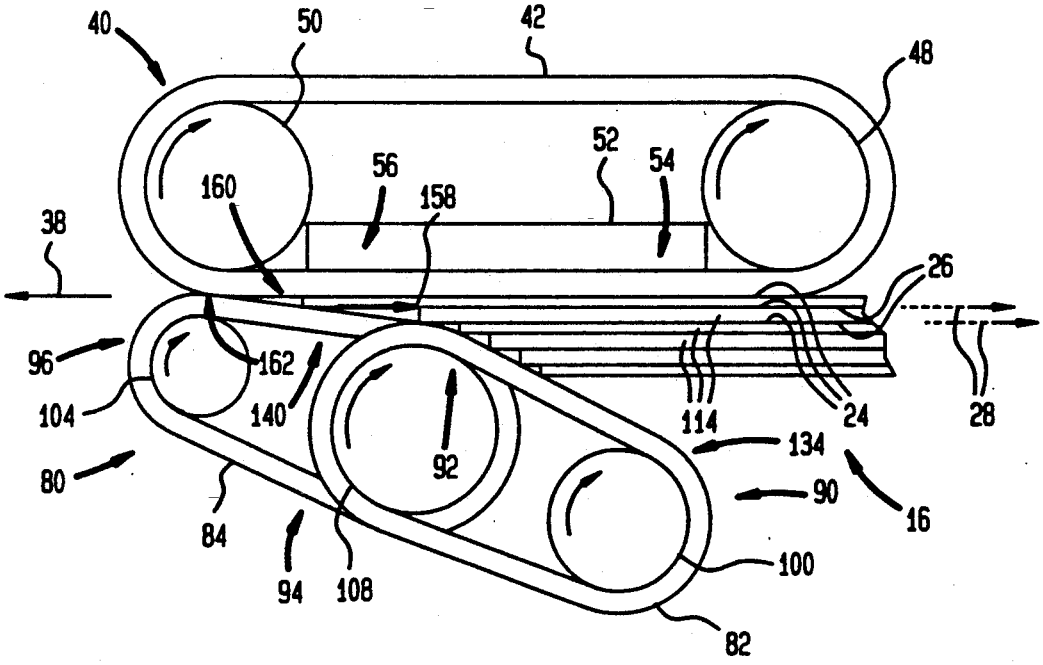
FIG. 7 is a plan view similar to FIG. 6, showing successive documents being fed further downstream by the belt structure of FIG. 1.

The above described operation of the singulating structure 18 has been found to reliably occur, for singulating successive documents 14 having the same or varying thickness and surface finish, in substantially all operation cycles. Occasionally however, the interdocument force 28 (FIG. 1) is such that the upstream force 158 exerted by the belts 84 are insufficient at the nip 152 between the upstream belt runs 54 and belt runs 140, to result in separating the document 14 engaged by the upstream belt run 54 from the next successive document 14. Whereupon, as shown in FIG. 7, two documents 14 are fed downstream beyond the pulleys 108 and guide plate 52. When this occurs, the downstream belt runs 56 and belt runs 140 engage the oppositely facing surfaces 24 and 26 of the overlapping documents 14. And, the documents 14 are separated from one another between the belt runs 56 and 140 and, a singulated document 14 is fed downstream from the singulating structure 18 by the downstream belt run 56.

In the preferred embodiment of the present invention, belts 42 have a high coefficient of friction, such as in rubber belts. Belts 82 and 84 have a lower coefficient of friction than belts 42, such as in urethane belts. It will be understood by those skilled in the art that other arrangements of belts for sections 86 and 88 may be suitable for particular applications. The important features of the present invention are the combined interleaved and friction feed arrangement of the various belts based on the spacing and location of the belts relative to each other, and the two pivoting sections of the second document feed structure. The present invention does not rely solely on the interleaved belt arrangement as in U.S. Pat. No. 5,074,540, previously noted. The present invention provides two separate pairs of belt runs, one of which is interleaved with the feed belts and one which is opposed to the feed belts. Each of the pair of belt runs pivot on separate axis to accommodate the documents being singulated.

In the above discussed modes of operation of the singulating structure 18, motors 60 and 144 (FIG. 1) are conventionally continuously energized for continuously rotating drive shafts 46 and 99 when stream feeding is desired. When demand feed is desired, motor 60 is indexed, for example by a stepper motor, and motor 144 is continuously energized for stopping and starting shaft 46 and continuously rotating shaft 99 and axle 98. In an alternative mode of operation for stream feeding, the motor 60 is continuously energized for rotating the drive shaft 46, whereas the motor 144 and gear system 146 may be eliminated, and the belt 82 manually advanced from time-to-time to promote uniform belt wear. In another alternate embodiment for demand feeding, motors 60 and 144 may both be stepper motors which index belts 42 and 82. Although, in the preferred embodiment, the moving belt runs 134 and 140 considerably reduce the number of "misses" (i.e., operation cycles in which document singulation does not occur, during a standardized reliability test time period of operation of the singulating structure 18).

While the present invention has been disclosed and described with reference to a single embodiment thereof, it will be apparent, as noted above that variations and modifications may be made therein. It is, thus, intended in the following claims to cover each variation and modification that falls within the true spirit and scope of the present invention.

What is claimed is:

1. In an apparatus for singulating respective documents fed thereto, wherein each of said documents is uprightly oriented on an edge thereof and has oppositely facing upright surfaces, and wherein each successive document is slidably movable relative to a next successive document against an interdocument frictional force developed therebetween, the apparatus comprising first document feeding means including at least two first belts and first means for moving said first belts downstream relative to a path of travel in vertically spaced first belt runs, and second document feeding means, adjacent said first document feeding means, including at least one second belt and second means for moving said second belt upstream relative to said path of travel in a second belt run, an improvement to said second document feeding means comprising:

a. a first section including an upstream end and a downstream end, said upstream end being pivotally mounted to a frame member, said first section also including at least two outboard endless belts therearound, said first section including second means for moving said outboard belts upstream relative to a path of travel in vertically spaced second belt runs, b. a second section having at least two inboard endless belts therearound, said second section being pivotably mounted at one end to said first section, c. means for coupling movement of said outboard belts of said first section to movement of said inboard belts of said second section for driving said inboard belts of said second section upstream relative to a path of travel in vertically spaced second section belt runs, d. means for resiliently urging said second section belt runs into interleaving relationship with said first belt runs, and for resiliently urging the downstream end of said first section belt runs towards said first belt runs, said urging means enabling said first and second sections to laterally flexed about said coupling means in response to said documents fed thereto;

e. said first belt runs exerting a downstream frictional force greater than an interdocument frictional force on an upright surface of each successive document for feeding thereof downstream in said path of travel, said first section and second section belt runs exerting an upstream frictional force greater than said interdocument frictional force on the oppositely facing upright surface of each next successive document for feeding thereof upstream relative to said path of travel, said second section belt runs exerting an upstream frictional force greater than said first section belt runs, and said downstream frictional force exceeding said upstream frictional force, whereby said first belt runs successively feed each successive document downstream in said path of travel against said interdocument and upstream frictional forces.

2. The improvement according to claim 1, wherein said second section further comprises first and second stop rollers rotatably mounted to the upstream and downstream ends of said second section between said second belt runs, wherein said first and second stop rollers are urged into rolling engagement with one of said first belt runs.

3. The apparatus according to claim 2, wherein said means for resiliently urging includes a first spring coupled to said first section for laterally resiliently urging the first stop roller into rolling engagement with the upstream end of the first belt run, said means for resiliently urging further including a second spring coupled to said second section for laterally resiliently urging the second stop roller into rolling engagement with the downstream end of the first belt run.

4. The improvement according to claim 1, wherein said means for resiliently urging includes a first spring coupled to said first section and a second spring coupled to said second section.

5. The improvement according to claim 1, wherein said second section belt runs have an upstream end and a downstream end, said resilient urging means including means for independently resiliently urging the upstream and downstream ends of said second section belt runs into interleaving relationship with said first belt runs.

6. The improvement according to claim 5, wherein said second section belt runs extend downstream substantially in alignment with a downstream portion of said first belt runs, and said first section belt runs extend upstream from said second section belt runs and progressively more laterally spaced apart from an upstream portion of said first belt runs, whereby the downstream end of said first section belt runs and said first belt runs define a nip therebetween and whereby the upstream end of said first belt runs and said first section belt runs define a wedge shaped document entry opening for receiving successive documents fed to said singulating apparatus.

7. The improvement according to claim 6, wherein said first belt runs feed successive documents fed thereto progressively downstream to said upstream end of said second section belt runs against the resilient urging of the upstream end of said first section belt runs, whereby said downstream end of said first section belt runs is moved out of interleaving relationship with said first belt runs thereby opening said nip.

8. The improvement according to claim 7, wherein said first belt runs progressively feed successive documents downstream in said path of travel against the resilient urging of the downstream end of said second section belt runs, whereby said second section belt runs are progressively moved out of interleaving relationship with said first belt runs.

9. The improvement according to claim 1, wherein said first belt runs engage and feed successive sheets downstream into said path of travel against the resilient urging of said second downstream belt run.

* * * * *